US012797686B2

(12) United States Patent
Prato et al.

(10) Patent No.: US 12,797,686 B2
(45) **Date of Patent: *Nov. 17, 2026**

(54) METHOD OF OPERATING A GYMNASTIC MACHINE WITH SELECTABLE PASSAGE MODES BETWEEN TRAINING TARGETS

(71) Applicant: Technogym S.p.A, Cesena FC (IT)

(72) Inventors: Renato Prato, Cesena FC (IT); Davide Gatti, Cesena FC (IT)

(73) Assignee: Technogym S.p.A., Cesena FC (IT)

( * ) Notice: Subject to any disclaimer, the term of this patent is extended or adjusted under 35 U.S.C. 154(b) by 100 days.

This patent is subject to a terminal disclaimer.

(21) Appl. No.: 18/963,592

(22) Filed: Nov. 28, 2024

(65) Prior Publication Data

US 2025/0177819 A1 Jun. 5, 2025

(30) Foreign Application Priority Data

Nov. 30, 2023 (IT) ..... 102023000025599

(51) Int. Cl.
*A63B 24/00* (2006.01)
*A63B 22/06* (2006.01)

(52) U.S. Cl.
CPC ..... *A63B 24/0087* (2013.01); *A63B 22/0605* (2013.01); *A63B 2024/0078* (2013.01)

(58) Field of Classification Search
CPC ..... A63B 21/005; A63B 21/0051; A63B 21/0056; A63B 21/154; A63B 21/225;
(Continued)

(56) References Cited

U.S. PATENT DOCUMENTS 3,869,121 A * 3/1975 Flavell ..... A63B 21/0058 482/901
10,576,348 B1 3/2020 Hawkins, III et al.
(Continued)

FOREIGN PATENT DOCUMENTS

CA 2039214 A1 * 9/1991 ..... A63B 22/0605
NL 1034645 C2 * 5/2009 ..... A63B 22/0605

OTHER PUBLICATIONS

Rapporto di Ricerca e l'Opinione Scritta [Search Report and the Written Opinion] Dated May 28, 2024 From the Ministero Delle Imprese e Del Made in Italy, Direzione Generale Sviluppo Produttivo e Competitivita, Ufficio Italiano Brevetti e Marchi Re. Application No. IT 202300025599. (10 Pages).

*Primary Examiner* — Gary D Urbiel Goldner

(57) ABSTRACT

A gymnastic machine has a force application system, a brake system, a transmission group, a detection system, and a logic control unit. During operation, a training program is selected that includes a passage from a first target to a second target, or the first and second targets are set in the gymnastic machine, each target being a value of a parameter associated with a gymnastic exercise. A passage mode from the first target to the second target is selected or set. In a first passage mode, the logic control unit adjusts a brake parameter corresponding to a brake action of the brake system using feedback control based on a signal from the detection system. In a second passage mode, the logic control unit instead holds the brake parameter at a constant value for a predefined period of time or until the second target is reached.

6 Claims, 3 Drawing Sheets

(58) Field of Classification Search
CPC ..... A63B 22/0605; A63B 24/0087; A63B 2024/0062; A63B 2024/0078; A63B 2024/0093; A63B 2220/34; A63B 2220/51; A63B 2220/54
See application file for complete search history.

(56) References Cited

U.S. PATENT DOCUMENTS

| | | | | |
|---|---|---|---|---|
| 2014/0171266 | A1* | 6/2014 | Hawkins, III ..... | A63B 22/0605 482/5 |
| 2018/0036586 | A1 | 2/2018 | Cristofori et al. | |
| 2019/0046834 | A1* | 2/2019 | Bacanovic ..... | A63B 24/0087 |
| 2019/0192914 | A1* | 6/2019 | Langford ..... | A63B 21/00196 |
| 2021/0106874 | A1 | 4/2021 | Cei | |
| 2025/0177820 | A1* | 6/2025 | Prato ..... | A63B 21/0051 |

* cited by examiner

METHOD OF OPERATING A GYMNASTIC MACHINE WITH SELECTABLE PASSAGE MODES BETWEEN TRAINING TARGETS

RELATED APPLICATIONS

This application claims the benefit of priority of Italy Patent Application No. 102023000025599 filed on Nov. 30, 2023, the contents of which are incorporated by reference as if fully set forth herein in their entirety.

FIELD AND BACKGROUND OF THE INVENTION

The present invention relates to a method of operation of a gymnastic machine.

Currently in gyms or home environments it is possible to carry out gymnastic training using equipment to simulate training even in real outdoor conditions.

For example, equipment such as spinning bike or cyclette to simulate cycling training in which, to simulate real pedaling on the road, the rotation speed of the flywheel, and therefore the inertia of the rotating pedals, depends on the cadence of the pedaling themselves and the set transmission ratio (gear), are known.

Some known types of equipment are equipped with manual systems for adjusting the cadence and resistance of the flywheel. This regulation is often inefficient and unreliable.

To overcome this problem, gymnastic equipment has been created, which includes a logical control unit, through which the user can set the cycling training parameters, and a sensor connected to the logical control unit, in which the sensor detects a signal relating to the torque acting on the flywheel shaft during the rotation and sends the signal to the control logic unit, and the control logic unit is configured to feedback adjust the braking force exerted by braking means on the flywheel.

These gymnastic equipment, however, do not allow training to be customized depending on the user's aptitude.

The aim of the present invention is therefore to adapt the reactivity of an exercise machine according to the user's preference.

SUMMARY OF THE INVENTION

According to the present invention, a method of operation of a gymnastic machine comprising a system for applying a force exerted by a user in the performance of a gymnastic exercise; a brake system to exert a braking action in response to the force exerted by the user; a group for transmitting the force exerted by the user to the brake system; at least one system for detecting the force exerted by a user when performing the gymnastic exercise; and at least one logic control unit connected to said brake system and to said detection system; the method comprising the steps of:

selecting a training program that provides the passage from at least one first target (Target_1) to at least one second target (Target_2) or set in the machine at least one first target (Target_1) and at least one second target (Target_2), wherein the target it is the value of a parameter associated with the gymnastic exercise;

selecting or setting in the machine a switching mode (MODE 0, MODE 1, MODE 2, MODE 3) from the first target (Target_1) to the second target (Target_2), wherein:

in a first switching mode (MODE 0), the control logic unit adjusts a brake parameter corresponding to the brake action exerted by the brake system with a feedback control based on at least one signal from the detection system;

in a second passage mode (MODE 1, MODE 2, MODE 3), the control logic unit maintains the brake parameter at a constant value (P_const) for a predefined period of time (T) or until the second is reached target (Target_2).

By setting a constant value of the brake parameter, the response of the machine is independent of the action performed by the user.

Advantageously, the brake parameter (P) is calculated as a function of at least said first target (Target_1) and second target (Target_2).

The calculation of the brake parameter according to the two targets allows taking into account the difficulty encountered by the user in passing and the response that the user expects based on their preferences.

BRIEF DESCRIPTION OF THE SEVERAL VIEWS OF THE DRAWINGS

The present invention will be now described, for illustrative but not limitative purposes, according to its preferred embodiments, with particular reference to the figures of the enclosed drawings, wherein.

DESCRIPTION OF SPECIFIC EMBODIMENTS OF THE INVENTION

The exercise machine which is the object of this invention is preferably a machine which has revolving levers which can be used with the arms or legs.

The exercise machine can, for example, be a machine for training the upper body, in which the user holds handles associated with levers which are hinged on the frame of the machine and rotates them.

In the following the description will be aimed at a cycling simulation exercise machine for gyms or domestic environments, but it is clear that it should not be considered limited to these specific uses.

Figure 1:
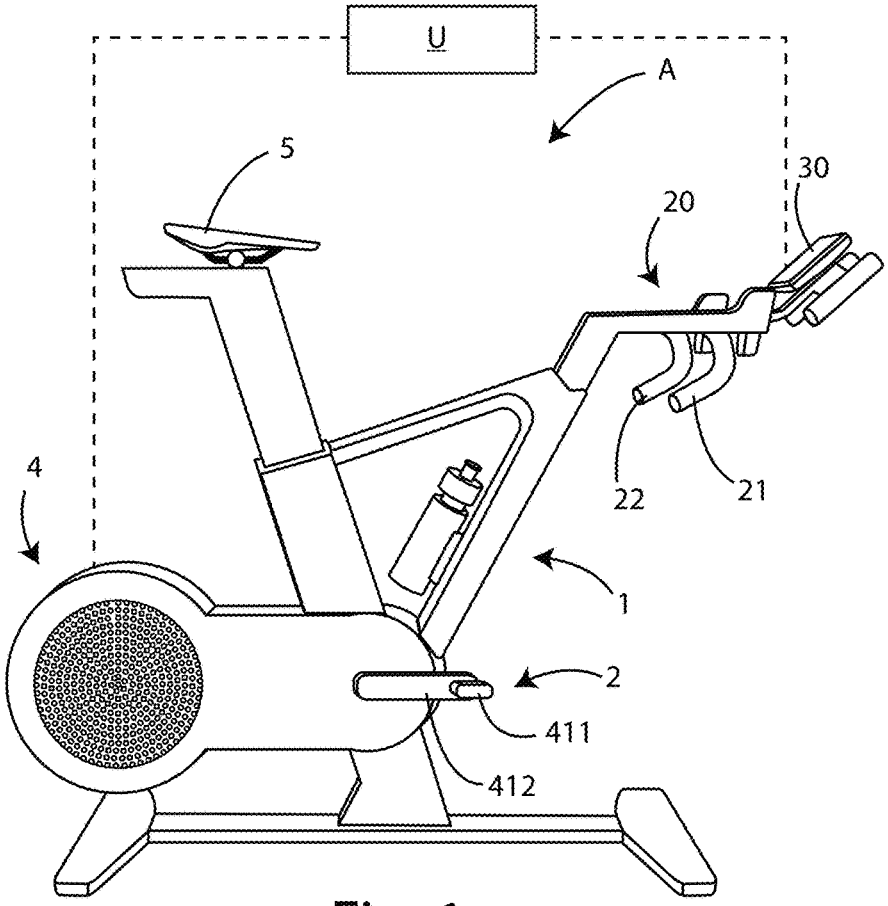
FIG. 1 shows a side view of a cycling simulation exercise machine.

FIG. 1 illustrates a cycling simulation machine A in a preferred embodiment of the present invention.

The gymnastic machine comprises a support frame 1, a system 2 for applying a force exerted by a user when performing a gymnastic exercise; a brake system 3 to exert a braking action in response to the force exerted by the user (FIGS. 2 and 3); a transmission unit 4 of the force exerted by the user to the braking system; and at least one control logic unit U connected to said brake system 3 and to said detection system 6.

The control logic unit U is capable of receiving at least one target set in the machine, where the target is the value of a parameter associated with the gymnastic exercise.

In particular, the target is the representative value of a quantity associated with the gymnastic exercise, such as for example a force, a torque, a power, etc.

The control logic unit U is capable of determining a brake parameter P corresponding to the braking action exerted by the brake system 3.

In the embodiment illustrated in FIG. 1, the machine comprises a support frame 1, a handlebar 20, for supporting the upper limbs of a user, an interface device 30, for the interaction between the user and said exercise machine A, a transmission unit 4, a logical control unit U and a seat 5 for the user.

The handlebar 20 comprises a first 21 and a second 22 handle arranged on opposite ends of the handlebar 20.

Figure 2:
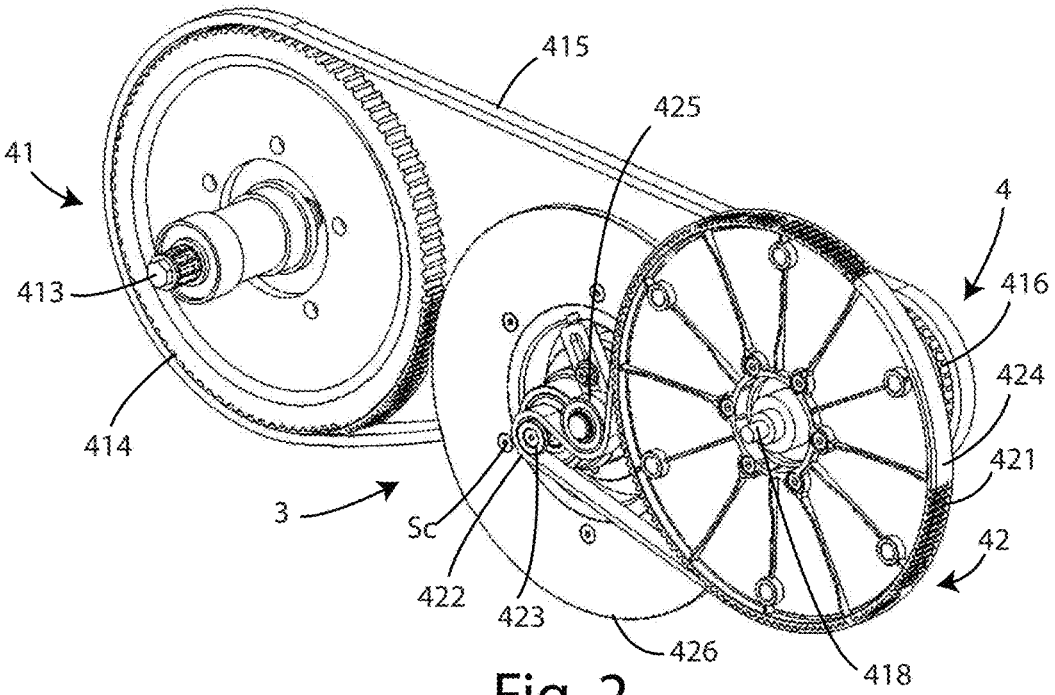
FIG. 2 shows a perspective view of a transmission assembly of the machine of FIG. 1.

Referring in particular to FIG. 2, the transmission assembly 4 comprises a main shaft 413, to which the cranks 412, which support the pedals 411 and a crown 414, are coupled, keyed onto said main shaft 413.

The transmission assembly 4 comprises a first transmission member 415, such as a belt or a chain, and a first pulley 416, on which said first transmission member 415 is engaged. The pulley is keyed onto a secondary shaft 418.

Advantageously, in the exercise machine the brake system 3 comprises a flywheel 426 keyed onto a respective shaft 423.

In the illustrated embodiment, the transmission assembly comprises a second pulley 421, having a larger diameter than said first pulley 416, and a third pulley 422, which is keyed onto the flywheel shaft 423. The brake system 3 comprises a second transmission member 424, such as a belt or chain, engaged on said second pulley 421 and on said third pulley 422 by means of a belt tensioner 425.

The brake system 3 advantageously comprises an electromagnetic brake F, in which the braking force exerted on said flywheel 426 is regulated by adjusting the current flowing through the turns of the windings.

Figure 3:
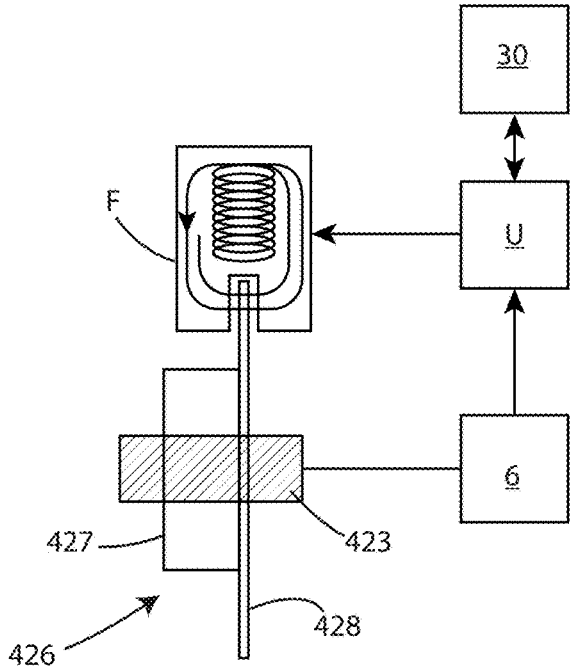
FIG. 3 schematically shows a detail of the braking system in a preferred embodiment.

The electromagnetic brake F is illustrated schematically in FIG. 3. In a preferred embodiment, the flywheel 426 comprises a substantially cylindrical steel body 427, to which a copper disk 428 is associated. The electromagnetic brake F has a groove, into which the copper disc 428 edge.

The exercise machine comprises a detection system 6 of the force exerted by a user in performing a gymnastic exercise, said detection system 6 being connected to the logical control unit U.

In particular, the detection system detects a representative value of the force exerted by a user when performing a gymnastic exercise.

Preferably, the detection system 6 comprises at least one sensor for direct measurement of the force or torque exerted by the user.

Figure 4:
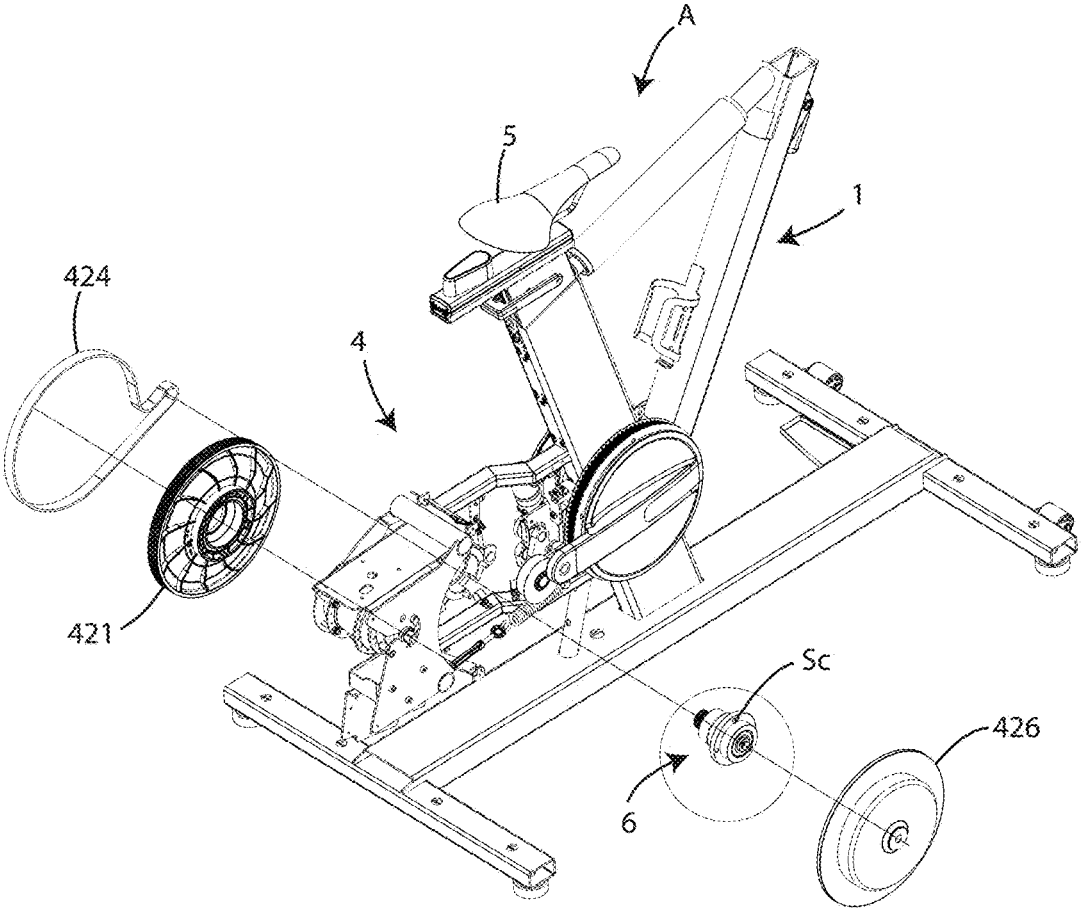
FIG. 4 shows a partially exploded perspective view of the machine of FIG. 1.

In the embodiment illustrated in FIG. 4, the detection system 6 comprises at least one torque sensor $S_c$, for example a torque meter.

The sensor $S_c$ is preferably installed on said flywheel shaft 423.

In alternative embodiments, the sensor is arranged on another drive shaft, such as the main shaft 413 or the secondary shaft 418.

In other embodiments, the sensing system comprises a force sensor, such as a load cell or strain gauge. The force sensor can be arranged on a pedal, or a crank or on a transmission member.

In the illustrated embodiment, the sensor $S_c$ is suitable for carrying out a measurement of the torque acting on the flywheel shaft 423 during the pedaling. The sensor $S_c$ is also suitable for measuring the rotation speed of said flywheel shaft 423, and therefore of said flywheel 426.

In an alternative embodiment, the detection system 6 comprises a sensor for measuring the rotation speed of said flywheel shaft 423.

Advantageously, the exercise machine comprises an interface device 30, for example a display o one monitor or the like, through which the user can set up a workout, view it and also view the characteristic parameters of a workout, such as for example the power and torque delivered by the user, the speed and cadence of pedaling.

As illustrated in FIG. 3, the interface device 30 is connected to the control logic unit U, to transmit data to the control logic unit U, such as for example the selections made by the user, and to receive data from the control logic unit U.

The control logic unit U can comprise a plurality of control groups. For example, a first group is configured for the control of actuators and sensors in the gymnastic machine and a second group is configured for the control of interface 30.

In a gymnastic machine, training means the user performing an exercise following a specific program stored in the memory of said logical control unit U.

The program comprises a temporal succession of a plurality of targets, in which the target is the value of a parameter associated with the gymnastic exercise. In particular, the target is the representative value of a quantity such as force, torque, power, etc. associated with exercise.

The program therefore provides for the transition from at least a first target value to at least a second target value, different from the first one.

The user can make manual changes to the pre-established programs, for example by setting a first target value of a parameter and a second target value, different from the first, or by selecting one of a plurality of workouts stored in the memory of said logical control unit U.

The control logic unit is configured to regulate the response of the exercise machine while reaching and maintaining a target value.

The control logic unit is configured to regulate the response of the exercise machine in the transition from at least a first target value to at least a second target value.

In a first control mode, the control logic unit adjusts the brake parameter corresponding to the brake force exerted by the brake system with a feedback control as a function of at least one signal from the detection system.

In feedback control the detection system essentially continuously measures a value that represents the force exerted by the user and sends a signal corresponding to the detected value to the control logic unit. The control logic unit calculates the value of the brake parameter based on the representative value of the detected force, and sends a signal to the brake system to increase or reduce the braking intensity.

In a basic training mode (MODE 0), of a known type, the logic control unit adjusts the braking force with a feedback control both during the maintenance of a first target and during the transition from the first to the second target.

According to the invention, the control logic unit U is configured to activate a second control mode (MFF) to switch from a first target (Target_1) to a second target (Target_2), wherein in the second control mode (MFF) the control logic unit U is configured for:

calculating a brake parameter (P) as a function of at least said first target (Target_1) and second target (Target_2);

maintaining the brake parameter (P) at a constant value (P_const) equal to the calculated value, during the operation of the exercise machine, for a predefined period of time (T) or until the second target (Target_2) is reached.

Preferably the control logic unit U keeps the brake parameter (P) at the constant value (P_const) until the second target (Target_2) is reached if the second target (Target_2) is reached in a time interval less than the default time period.

In this way the brake parameter (P) does not depend on the force or the torque or the power exerted by the user, but it is kept constant while reaching the second target.

The value of the brake parameter that must be kept constant depends on several factors, as illustrated below.

Preferably, the control logic unit U is configured to calculate the difference between the first target and the second target (ΔTarget).

For ease of description, it is assumed that the control unit is continuously controlling the gymnastic machine, so that the first target is maintained. The representative value of the force supplied by the user substantially corresponds to the value of the first target set in the control unit, as in the feedback control the braking action is regulated in such a way as to keep the force exerted by the user equal to the first target.

In particular, the control logic unit U is configured to calculate the percentage variation (ΔTarget %) between the first target and the second target.

Preferably the control logic unit U is configured to calculate the percentage variation (ΔTarget %) between the first target and the second target with respect to at least one of the first and second targets.

The control logic unit U is configured to calculate the value of the brake parameter to be kept constant as a function of the percentage variation (ΔTarget %) between the first target and the second target.

In this way, the amplitude of the variation of the target with respect to at least one of the first and second targets is taken into account.

In a preferred embodiment of the invention, the user can choose between several training options, other than the basic training mode of known type (where operation occurs according to the first control mode (MI)), depending on the response desired from the machine.

The value of the brake parameter depends on the training option selected by the user, who can, therefore, choose a different machine response when moving from the first to the second target.

Advantageously, the control logic unit is configured to set a value of a response coefficient ($K_i$) of the machine when passing from the first target (Target_1) to the second target (Target_2); and to calculate the brake parameter value from keep constant (P_const) depending on the value of the coefficient ($K_i$) set.

Preferably, the control logic unit is configured to calculate the value of the brake parameter to be kept constant as a function of the response coefficient ($K_i$) representative of a training option selected or set by the user.

In particular, the U control logic unit is configured to:

receive the second target (Target_2);

detect the value of the brake parameter (P_in) upon receiving the second target (Target_2);

calculate a variation of the brake parameter (ΔP) by multiplying the percentage variation (ΔTarget %) between said first target and said second target by a predefined value of said response coefficient ($K_i$);

calculate the value (P_const) of the brake parameter to be kept constant by adding or subtracting the variation of the brake parameter (ΔP) to the value of the brake parameter (Pin) detected, when the second target value (Target_2) is received.

According to a preferred embodiment of the present invention, the machine comprises an interface (30) for the selection of at least one training program, which involves the passage from at least a first target (Target_1) to at least a second target (Target_2) or for the setting of at least one first target (Target_1) and at least one second target (Target_2) by a user.

The interface 30 is configured for the selection or the setting of at least one training option (MODE 1, MODE 2, MODE 3), the control logic unit (U) being configured to set the response coefficient ($K_1$, $K_2$, $K_3$) depending on the training option selected or set by the user.

According to an aspect of the present invention, a method of operating a gymnastic machine includes the steps of:

set in the machine at least a first target (Target_1) and at least a second target (Target_2), where the target is the value of a parameter associated with the gymnastic exercise;

regulating a brake parameter (P) with feedback control as a function of at least one signal of the detection system (6) in a first control mode, wherein the brake parameter (P) is a parameter corresponding to the action of braking exerted by the braking system (3);

receiving the second target (Target_2) in the control unit (U);

upon receipt of the second (Target_2), activating a second control mode (MFF) including the step of:

calculating the value of a brake parameter (P) as a function of at least said first target (Target_1) and said second target (Target_2); and maintaining the brake parameter (P) at a constant value (P_const) equal to the calculated value, during the operation of the exercise machine, for a predefined time period, or until the second target (Target_2) is reached.

The setting of a first or second target in the machine can be carried out directly by a user via the interface or it can be carried out by the control unit of the machine following a selection made by a user relating for example to a training.

Preferably, the brake parameter (P) is kept at a constant value (P_const) until the second target (Target_2) is reached if the second target (Target_2) is reached in a time interval shorter than the predefined time period.

Advantageously, the method includes the steps of:

setting a coefficient value ($K_i$) of the machine's response when moving from the first target (Target_1) to the second target (Target_2); and calculating the value of the brake parameter (P_const) to be kept constant as a function of the value of the coefficient ($K_i$) set.

Preferably, the method involves selecting at least one training option (MODE 1, MODE 2, MODE 3) and setting a response coefficient value ($K_1$, $K_2$, $K_3$) depending on the training option selected by the user.

In an advantageous embodiment, the method comprises the steps of:

selecting at least one training program that involves the transition from at least one first target (Target_1) to at least one second target (Target_2);

selecting at least one switching mode (MODE 0, MODE 1, MODE 2, MODE 3) from the first target (Target_1) to the second target (Target_2);

operating the machine in the first control mode to maintain the first target (Target_1);

receiving the second target (Target_2) in the control logic unit (U);

activating the selected passing mode (MODE 0, MODE 1, MODE 2, MODE 3) upon receiving the second target (Target_2);

controlling the machine in the second control mode (MFF).

In a first switching mode (MODE 0), the control logic unit (U) adjusts the brake parameter (P) with a feedback control according to the first control mode (MI); in a second switching mode (MODE 1, MODE 2, MODE 3), the control logic unit activates the second control mode (MFF).

According to another aspect of the present invention, a method of operating the gymnastic machine comprises the steps of:

selecting a training program that involves the passage from at least a first target (Target_1) to at least a second target (Target_2) or setting in the machine at least a first target (Target_1) and a second target (Target_2), in which the target is the value of a parameter associated with the gymnastic exercise;

selecting or setting in the machine a switching mode (MODE 0, MODE 1, MODE 2, MODE 3) from the first target (Target_1) to the second target (Target_2), in which:

in a first switching mode (MODE 0), the control logic unit adjusts a brake parameter corresponding to the braking action exerted by the brake system (3) with a feedback control based on at least one signal from the brake system detection (6);

in a second switching mode (MODE 1, MODE 2, MODE 3), the control logic unit maintains the brake parameter at a constant value (P_const) for a predefined time period or until the second target (Target_2) is reached.

In particular, the target is a representative value of a quantity associated with the gymnastic exercise, such as the force, the torque, the power, etc.

Preferably, the control logic unit keeps the brake parameter at a constant value (P_const) until the second target (Target_2) is reached if the second target (Target_2) is reached in a time interval shorter than the predefined time period (T).

Advantageously, the method comprises the steps of:

selecting or set a training option in the machine (MODE 1, MODE 2, MODE 3) in the second switching mode, in which the selected or set training option corresponds to a response coefficient value ($K_1$, $K_2$, $K_3$);

calculating the value of the brake parameter (P_const) to be kept constant as a function of the value of the coefficient ($K_1$, $K_2$, $K_3$) set.

Preferably, the second passage mode comprises the steps of:

calculating a brake parameter (P) as a function of at least said first target (Target_1) and second target (Target_2);

maintaining the brake parameter (P) at a constant value (P_const) equal to the calculated value, during the operation of the exercise machine, for a predefined period of time (T), or until the second target (Target_2) is reached if the second target (Target_2) is reached in less than the predefined time period (T).

In a preferred embodiment, the second passage mode comprises the steps of:

calculating the percentage difference (ΔTarget %) between said first target (Target_1) and said second target (Target_2);

calculating the value of the brake parameter (P_const) to be kept constant as a function of at least said percentage difference (ΔTarget %).

Preferably, the percentage difference (ΔTarget %) between said first target (Target_1) and said second target (Target_2) is calculated with respect to said first target (Target_1) or said second target (Target_2).

In particular, the method comprises the steps of:

adjusting the brake parameter (P) with a feedback control (MI) based on at least one signal from the detection system (6) while maintaining the first target (Target_1);

receiving the second one (Target_2) in the control logic unit;

upon receiving the second target (Target_2), activating the second passage mode (MODE 1, MODE 2, MODE 3);

detecting the achievement of the second target (Target_2) via the detection system (6);

upon reaching the second target (Target_2), resuming the feedback control (MI) to maintain the second target (Target_2).

In a preferred embodiment, the method comprises the steps of:

adjusting the brake parameter (P) with a feedback control (MI) based on at least one signal from the detection system (6) while maintaining the first target (Target_1);

receiving the second one (Target_2) in the control logic unit;

upon receiving the second target (Target_2), activating the second switching mode (MODE 1, MODE 2, MODE 3) with a constant value (P_const) of the brake parameter;

maintaining the brake parameter (P) at a constant value (P_const) during the operation of the exercise machine for a predefined period of time (T);

at the end of the predefined time, resuming feedback control (MI) to maintain the second target (Target_2).

In the cycling simulation gymnastic machine illustrated in the figures, there can be two types of training: power training and slope training.

Power training includes a temporal succession of predetermined or assigned power values; each predetermined power value can be assigned for respective time intervals. For example, training may involve maintaining a power of 50 Watts for 60 seconds, then subsequently switching from 50 to 100 Watts and maintaining 100 Watts for 120 seconds and so on.

The control logic unit U is configured to control the resistance, based on the detected angular velocity, so that the power values are those predetermined or assigned by the training program.

In slope workout, the user can select one of a plurality of training sessions stored in the memory of said control logic unit U based on pre-established real routes. Also in this case, the user can make manual changes to the pre-established route, for example by changing the slope.

In a power workout, a user must perform the workout while maintaining the set power value unchanged.

For example, once a constant power value has been set and the value of the torque present on said flywheel is known, based on the rotation speed of the flywheel, the logic unit U adjusts the brake parameter to maintain the power at the set value.

The power exerted by the user is given by the product between the torque acting on the shaft 423 of said flywheel 426, and the rotation speed of said flywheel shaft 423.

Based on the pedaling speed, said control logic unit U regulates the braking force acting on said flywheel 426.

In particular, during the rotation of said flywheel shaft 423, said torque sensor $S_c$ periodically detects, according to a known method, the torque acting on said flywheel shaft 423, based on its rotation speed, and sends this data to said control logic unit U, which regulates the current supplied to the electromagnetic brake and therefore the intensity of the braking force exerted, in order to maintain the power at a predetermined value (set by the user or prescribed/assigned by the training program).

In slope training, the user can select, using the interface device 30, a workout based on a pre-established route.

The user can also set a gear ratio for the preset route.

Based on the set slope and the transmission ratio, the logic control unit determines the braking force of the flywheel, which is then adjusted with the feedback control based on the torque detected by the torque meter.

The control logic unit is configured to regulate the response of the gymnastic machine in the transition from at least a first target value to at least a second target value.

Preferably, at least one workout program is selected in interface 30, which involves the passage from at least one first target to at least one second target or at least one first target is set by the user to at least one second target.

Advantageously, the interface 30 presents a plurality of switching modes from the first to the second target, for example a first standard mode (Mode 0) and a second switching mode, with three different training options (Mode 1, Mode 2, Mode 3), each option corresponding to a different reactivity of the machine in the transition from the first to the second target and therefore to the intensity of the training.

For example, in the first option the machine's response is such as to make the transition from the first target to the second target more gradual and more distributed over time (Mode 1), consequently the user will take longer to reach the second target. In the third option (Mode 3), however, the machine's response is such as to make the transition from the first target to the second target very dynamic and more concentrated in time, consequently the user will take less time to reach the second target.

In a preferred embodiment, in the first (standard) switching mode the control of the machine remains a feedback control. In other words, the braking action is feedback adjusted both to reach and maintain the first target and to reach and maintain the second target.

In the second switching mode, control occurs by maintaining the brake parameter at a constant value.

Advantageously, the constant value depends on the selected training option, which corresponds to a coefficient value ($K_i$) response of the machine.

The operation of the gymnastic machine is described for illustrative purposes with reference to the cycling simulation machine illustrated in the figures, but applies to other types of exercise equipment.

When it is intended carrying out a training in a closed space, in which said exercise machine A is available, a user preliminarily interacts with said interface device 30 to set the type of training among those available. For example, the user selects a training program and a machine response option, which can be more or less dynamic, depending on personal preferences. For example, the machine can provide the following 3 response options: "slow", "medium" and "fast".

During the operation of said exercise machine A for cycling simulation, for example, the user can select the "fast" option within a constant power training program.

Selecting a particular option involves setting a default coefficient $K_i$ response in the control logic unit U.

In a constant power workout, a user performs the workout and the control logic unit U keeps the user's power output equal to the set power value. The training program involves reaching and maintaining a first power target for an interval of time and then reaching and maintaining a second power target. According to the user's selection, the transition from the first target to the second target can for example be "fast", to simulate a shot.

In the time interval in which the user must maintain the first power target, the operation of the machine is of the known type, with feedback control, also known as "follower". The control logic unit activates the operation of the machine in the first control mode.

In the illustrated case of a cycling simulation machine, the power exerted by the user is given by the product between torque and the rotation speed of said flywheel shaft 423.

Based on the pedaling speed, the logic control unit U regulates the braking force acting on said flywheel 426.

In particular, during the rotation of said flywheel shaft 423, said torque sensor $S_c$ periodically detects, according to a known method, the torque acting on said flywheel shaft 423, based on its rotation speed, and sends this data to said control logic unit U.

The control unit regulates the current supplied to the electromagnetic brake by creating a feedback control.

To maintain the brake parameter at a constant value, the control logic unit is preferably configured to maintain the current supplied to said electromagnetic brake at a constant value.

Upon receipt of the second target value (Target_2), the second control mode is activated.

The value of a current parameter (I) supplied to the electromagnetic brake is detected.

The control unit U calculates the difference between the second power target and the first power target (ΔTarget), from which it obtains the percentage variation (ΔTarget %), in particular, compared to the first target (Target_1) or to the second target (Target_2).

The change in the current parameter (ΔI) is calculated as the product of a response coefficient ($K_i$) and the percentage change of the difference between the first target value and the second target value (ΔTarget %).

The new value of the current parameter supplied to the electromagnetic brake, corresponds to a new value of the braking force.

The current corresponding to the new value is supplied to the electromagnetic brake and it is maintained until the second target is reached, or for a predetermined amount of time. During this time period, the braking action of the machine depends only on the current supplied, and not on the force exerted by the user.

If the user has selected the "quick" option, the braking action of the machine will be such as to make the transition from the first target to the second target immediate.

If the user has, instead, selected the "slow" option, the braking action of the machine will be such as to make the transition from the first target to the second target more gradual.

Advantageously, the detection of the force or torque using a direct measurement sensor, such as the torque meter, allows the parameters necessary for the operation of the machine to be instantly adjusted.

Figure 5:
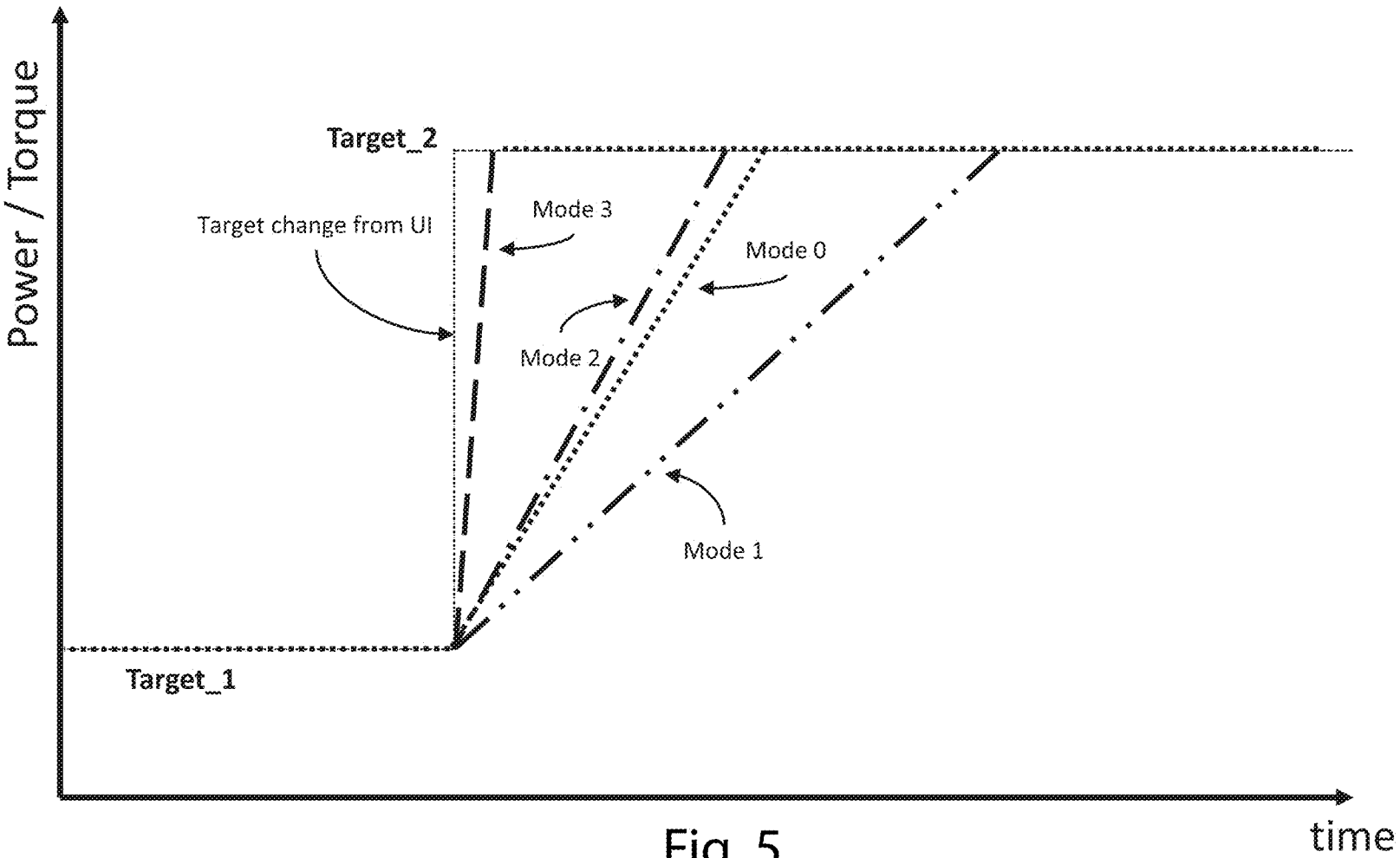
FIG. 5 shows a graph representing an example of operation of an exercise machine in a preferred embodiment of the present invention.

FIG. 5 illustrates a target change in power training according to the "pursuit" mode, which involves feedback control of a known type, and in three other training options.

The graph shows the power (or torque) as a function of time.

The straight line perpendicular to the axis in which the time is reported indicates the moment of "target change", i.e. the moment in which the control unit U receives the second target (Target_2) set or selected in interface 30 (User Interface).

In the "follower" mode (Mode 0), the transition from the first target to the second target has a substantially linear trend (for ease represented as a straight line) in a given time interval Δt.

In a first training option, for example called "slow" (Mode 1), the passage from the first target to the second target has a substantially linear trend (for simplicity, represented as a straight line) but in a longer time interval compared to the standard "follower" mode and the slope of the line is lower.

In a second training option, for example called "average" (Mode 2), the passage from the first target to the second target has a substantially linear trend (for simplicity represented as a straight line) but in a time interval more similar to the mode standard "follower" mode and the slope of the line is close to the other, i.e. similar to that of the "follower" mode.

In a third training option, more dynamic, for example called "quick" (Mode 3), the passage from the first target to the second target has a substantially linear trend (for simplicity represented as a straight line) but in a longer time interval shorter than the standard "follower" mode and the slope of the line is steeper.

The exercise machine object of the present invention, therefore, allows for personalized training according to the user's preferences.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A method of operation of a gymnastic machine, the gymnastic machine comprising a system for applying a force exerted by a user when performing a gymnastic exercise; a brake system to exert a brake action in response to the force exerted by the user; a transmission group to transmit the force exerted by the user to the brake system; at least one detection system to detect the force exerted by the user when performing the gymnastic exercise; and at least one logic control unit (U) connected to the brake system and to the at least one detection system; the method comprising the steps of:

receiving at least one target set in the gymnastic machine, the at least one target being a value of a parameter associated with the gymnastic exercise;

· selecting a training program that comprises a passage from a first target (Target_1) of the at least one target to a second target (Target_2) of the at least one target or setting in the gymnastic machine at least the first target (Target_1) and at least the second target (Target_2); and selecting or setting in the gymnastic machine a passage mode (MODE 0, MODE 1, MODE 2, MODE 3) from the first target (Target_1) to the second target (Target_2), wherein:

in a first passage mode (MODE 0) of the passage mode, the at least one logic control unit (U) adjusts a brake parameter (P) corresponding to the brake action exerted by the brake system (3) with a feedback control as a function of at least one signal from the at least one detection system (6); and in a second passage mode (MODE 1, MODE 2, MODE 3) of the passage mode, the at least one logic control unit (U) maintains the brake parameter (P) at a constant value (P_const) for a predefined period of time (T) or until the second target (Target_2) is reached.

2. The method according to claim 1, further comprising the steps of:

selecting or setting a training option (MODE 1, MODE 2, MODE 3) in the gymnastic machine in the second passage mode, wherein the selected or set training option corresponds to a response coefficient value (K1, K2, K3); and calculating the value of the brake parameter (P_const) to be kept constant as a function of the response coefficient value (K1, K2, K3).

3. The method according to claim 1, wherein the second passage mode comprises the steps of:

calculating the brake parameter (P) as a function of at least the first target (Target_1) and the second target (Target_2); and maintaining the brake parameter (P) at the constant value (P_const) equal to the calculated value, during the operation of the gymnastic machine, for the predefined period of time (T) or until the second target (Target_2) is reached if the second target (Target_2) is reached in a lower time than the predefined period of time (T).

4. The method according to claim 1, wherein the second passage mode comprises the steps of:

calculating a percentage difference (ΔTarget %) between the first target (Target_1) and the second target (Target_2); and calculating the value of the brake parameter (P_const) to be kept constant as a function of at least the percentage difference (ΔTarget %).

5. The method according to claim 1, further comprising the steps of:

adjusting the brake parameter (P) with the feedback control (MI) as the function of the at least one signal from the at least one detection system (6) while maintaining the first target (Target_1);

receiving the second target (Target_2) in the at least one logic control unit (U);

upon receiving the second target (Target_2), activating the second passage mode (MODE 1, MODE 2, MODE 3);

detecting a reaching of the second target (Target_2) by the at least one detection system; and upon reaching the second target (Target_2), resuming the feedback control (MI) to maintain the second target (Target_2).

6. The method according to claim 1, further comprising the steps of:

adjusting the brake parameter (P) with the feedback control (MI) as the function of the at least one signal from the at least one detection system while maintaining the first target (Target_1);

receiving the second target (Target_2) in the at least one logic control unit (U);

upon receiving the second target (Target_2), activating the second passage mode (MODE 1, MODE 2, MODE 3) with the constant value (P_const) of the brake parameter (P);

maintaining the brake parameter (P) at the constant value (P_const) during the operation of the gymnastic machine for the predefined period of time (T); and at an end of the predefined period of time (T), resuming the feedback control (MI) to maintain the second target (Target_2).

* * * * *